United States Patent [19]

Yonekura et al.

[11] Patent Number: 4,643,241

[45] Date of Patent: Feb. 17, 1987

[54] METHOD OF PREPARING COMPOSITE ALUMINUM MATERIAL

[75] Inventors: Koji Yonekura; Kenichi Suzuki; Yoshiyasu Takahashi, all of Nagoya; Hiroaki Iwahori, Aichi, all of Japan

[73] Assignee: Kabushiki Kaisha Toyota Chuo Kenkyusho, Aichi, Japan

[21] Appl. No.: 757,876

[22] Filed: Jul. 23, 1985

[30] Foreign Application Priority Data

Jul. 26, 1984 [JP] Japan ..... 59-156276

[51] Int. Cl.[4] ..... B22D 19/00

[52] U.S. Cl. ..... 164/101; 164/55.1

[58] Field of Search ..... 164/55.1, 54, 67.1, 164/75, 101, 102, 103, 53, 91, 66.1; 75/259; 228/223

[56] References Cited

U.S. PATENT DOCUMENTS 3,951,328 4/1976 Wallace ..... 228/223

*Primary Examiner*—Kuang Y. Lin
*Assistant Examiner*—G. M. Reid
*Attorney, Agent, or Firm*—Parkhurst & Oliff

[57] ABSTRACT

A method of preparing a composite aluminum material to be formed integrally by bonding aluminum or aluminum alloy to an aluminum or aluminum alloy member which is formed in advance in a specified shape by the method of internal chill, etc. The method comprises the steps of forming a chemical conversion coating of pentafluoroaluminate ($K_2AlF_5$) by bringing a solution containing potassium ions and fluorine ions in contact with the surface of the aluminum member.

8 Claims, 5 Drawing Figures

METHOD OF PREPARING COMPOSITE ALUMINUM MATERIAL

BACKGROUND OF THE INVENTION

1. Field of the Invention

This invention relates to a method of preparing composite aluminum material to be formed integrally by cast bonding aluminum or aluminum-alloy to an aluminum member, which comprises aluminum material.

2. Description of the Prior Art

Aluminum material or aluminum alloy material (hereinafter referred to as aluminum material) has been used not only in airplanes but also in various kinds of parts, due to its light weight and strength. Recently, there has been a demand to have the aluminum material provided with a specified property, such as high corrosion resistance, on all or part of its surface without losing the advantage of light weight. Thus light metal materials are formed by forming an aluminum layer having high corrosion resistance on an aluminum alloy casting having a high mechanical strength and by providing roller aluminum plate having a high mechanical strength on the aluminum alloy castings.

In the case of providing a specified property on all surfaces of an aluminum casting or partial surface thereof or in the case of providing a special shape on one part of an aluminum casting for a specified function, it might be considered to make use of the internal chill method at the time of casting molten aluminum on the aluminum material member which is prepared in advance. This method has been used often in the case of iron (ferrous) material. However, in the case of aluminum material, there is a disadvantage in that the surface of the member is covered with a fine oxide film, so that the aluminum layer, which is formed from molten aluminum, cannot bond sufficiently to the surface of the member. For affecting sufficient bonding of the layer to the member, attempts have been made to raise sufficiently the temperature of the molten aluminum or pre-heat the member in advance to result in good bonding. However, the conditions required to achieve sufficient bonding are quite critical with small ranges, and it is difficult to get even bonding.

Accordingly, this internal chill method is effective only for the composite material which needs to be formed by being covered with the aluminum, but not for the composite material which may be exposed to large temperature changes or mechanical force, or which needs high mechanical strength or air-tightness.

Furthermore, it is also considered a use of the internal chill method when applying flux on the surface of the member, but the conventional flux comprising $ZnCl_2$ or NaCl, etc., does not have sufficient ability to remove oxide film. In addition, in case of a thin layer thereof, the flux may not be effective for that purpose and, to the contrary, a portion of the flux may remain as a thick layer in the composite material, thereby preventing a high bonding strength. Additionally a residue of the chloride on the surface of the member may corrode the composite material later formed.

As a non-corrosive flux, potassium tetrafluoroaluminate ($KAlF_4$) has been known, but this is insoluble in solvents such as water, so that when using, it needs to be powdered and even application is not effected. Furthermore, even though it is applied in suspension, at the time of setting the member into a mold after drying, the flux releases from the surface to have been coated.

SUMMARY OF THE INVENTION

An object of this invention is to provide a method of preparing a composite aluminum material to be formed integrally by cast bonding aluminum or aluminum alloy, to an aluminum or aluminum alloy member, which is formed in advance in a specified shape, by the internal chill method, etc.

A futher object of this invention is to provide a method of preparing a composite aluminum material, the member portion of the composite and the aluminum or aluminum alloy casting being protected from corrosion.

Yet another object of this invention is to provide a method of preparing a composite aluminum material having high mechanical strength and corrosion resistance by using the member made by rolling or forging, also having high mechanical strength or chemical resistance such as corrosion resistance.

A still further object of this invention is to provide a composite aluminum material prepared according to the method of this invention.

The method according to the present invention is characterized in that it comprises the steps of forming a chemical conversion coating of potassium pentafluoroaluminate ($K_2AlF_5$) by bringing a solution containing potassium ions and fluorine ions in contact with the necessary surface of the aluminum member (which is formed in advance in specified shape) and forming the aluminum or aluminum alloy casting integrally with the member by bringing the member in contact with molten aluminum or aluminum alloy.

DETAILED DESCRIPTION

Figure 1:
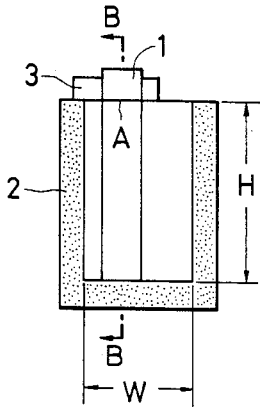
FIG. 1 is a sectional view showing a mold.

The aluminum material of the present invention means a material comprising aluminum or aluminum alloy, the components of which are not particularly restricted and may include one or more additional elements such as silicon(Si), copper(Cu), manganese(Mn), zinc(Zn), titanium(Ti), chromium(Cr), zirconium(Zr), magnesium(Mg), etc. which are normally contained in aluminum alloys. In addition, the quantity of elements contained therein is also particularly restricted. However, it is preferable to use the one which contains not more than 1% by weight of magnesium(Mg).

Furthermore, as the aluminum alloy member, there may also be used a cladding obtained from aluminum or the aforesaid aluminum alloy material by cladding or coating it with an alloy having a melting point of 10°–100° C. lower than the former, e.g., an Al-Si alloy containing 7–12% by weight of Si on the surface.

The aluminum member according to this invention may be castings, rolled or forged, and the shape and size thereof is not particularly restricted.

The treating solution containing potassium ions and fluorine ions which is used for the treating step in this invention is normally aqueous solution, and there are some recommended methods for preparing it as follows.

One of those is a method of dissolving potassium hydrogen fluoride ($KHF_2$) in water. The amount of $KHF_2$ dissolved is preferably 1–80 g per liter of water for producing $K_2AlF_5$. If the amount of the $KHF_2$ is less than 1 g/1, the forming rate of the $K_2AlF_5$ chemical conversion coating layer is low and hence it takes a longer time for the formation of the desired amount of the $K_2AlF_5$. On the other hand, if more than 80 g/1 is used, the concentration of the solution is so high that $K_3AlF_6$ tends to be formed, thus making it impossible to efficiently obtain the $K_2AlF_5$.

Another method of preparing the treating solution is to dissolve potassium fluoride (KF) and hydrogen fluoride (HF) in water to prepare a mixed aqueous solution. Alternatively, this may also be a solution obtained by dissolving potassium hydroxide (KOH) and hydrogen fluoride in water.

These aqueous solutions are preferably such that the molar ratio of the fluorine ions to potassium ions contained in the aqueous solutions is 1–10 and the potassium ions is contained in an amount of 0.01–1 mole/1. If the aforesaid molar ratio exceeds 10, the aluminum member is etched to a greater extent and hence the surface is roughened; this is therefore not preferable. On the contrary, if the molar ratio is less than 1, it is difficult to form the $K_2AlF_5$.

The reason why these treating solutions are mixed aqueous solutions of potassium fluoride or potassium hydroxide and hydrogen fluoride ions is that the addition of the fluorine increases the molar ratio of the fluorine ions and also promotes the reaction with the aluminum by making the treating solution acidic.

As the method of bringing the aforesaid aluminum member and the treating solution in contact with each other, in addition to the above-described method of immersing the aluminum member, there are methods of brushing or spraying the solutions on at least a desired part of the aluminum member. In this case, it is desirable to supply a considerably large amount so that enough potassium ions and fluorine ions in the treating solution react with the aluminum member.

Although the time for contact between said aluminum material and said treating solution cannot be determined unconditionally because it depends on the concentrations of the potassium ions and fluorine ions in the treating solution and the temperature of the treating solution, it is, for example, preferably in the range of about 0.5 sec. to 20 min.

Since the treating solution is a solution in a form where the KF and HF are mixed, by said contact, the oxide film present on the surface of the aluminum member is destroyed and the aluminum, potassium ions and fluorine ions chemically react to form $K_2AlF_5$. The formation of the $K_2AlF_5$ varies also depending on the temperature of the treating solution. Naturally, the chemical reaction can proceed at room temperature. However, if the temperature of the treating solution is raised to 40°–70° C., the removal of the oxide film is effected completely and yet rapidly. As a result, the $K_2AlF_5$ is gradually formed as a firm chemical conversion coating layer on the surface of the aluminum member.

These members may be subjected to the aforesaid chemical conversion coating step as such in the form of a material, or they may be subjected to this step after being processed into a predetermined form or after assembling. The surface of the aluminum member may be degreased before the chemical conversion coating step by using an organic solvent such as trichloroethylene. Furthermore, the oxide film may be removed beforehand by using, e.g., hydrogen fluoride. Thus, the surface of the aluminum member may be cleaned before the chemical conversion coating step.

Furthermore, this chemical conversion coating step may also be conducted by arranging counter electrodes in the aforesaid treating solution and applying a voltage across said counter electrodes and the aluminum member. In this case, the material for the counter electrodes is preferably a material which does not dissolve in the treating solution as ions such as a carbon.

The chemical conversion coating step may also be conducted by applying an alternating current. In this case, an alternating voltage is applied across a pair of aluminum members. In this method, when the voltage is high, $K_2AlF_5$ is formed on the material but when the voltage becomes negative, it is not dissolved. Accordingly, only when the voltage becomes positive is $K_2AlF_5$ formed on the aluminum member.

Thus, in the cases of applying both direct voltage and alternating voltage, the forming rate of $K_2AlF_5$ is greater than when no voltage is applied. Thus a desired amount of the chemical conversion coating layer of $K_2AlF_5$ is obtained in a shorter time.

When the $K_2AlF_5$ has been formed in an amount of 0.1–10 g/m$^2$ the contact of the aluminum member and the treating solution may be ceased.

At that time, the unreacted potassium ions and fluorine ions are still present on the surface of the aluminum member subjected to the aforesaid chemical conversion coating step. The remaining potassium ions and fluorine ions may be washed away with water, or may be left in place because they do not interfere with the subsequent step.

In addition, the treated aluminum member may further be subjected to a drying step. The drying step is effected by evaporating the water remaining on the surface of the aluminum member. Where water washing is not conducted after the chemical conversion coating step, it is also possible, by this step, to react the potassium ions and fluorine ions remaining on the surface of the aluminum material with the aluminum to form more $K_2AlF_5$. However, if excessive potassium and fluorine remain, the potassium ions and fluorine ions form $KHF_2$, and the remaining water evaporates. As a result, water-free $KHF_2$ remains on the surface of the aluminum member. Since the $KHF_2$ has no hygroscopic nature and hence does not become sticky by spontaneously absorbing atmospheric moisture, handling of the member is easy. Moreover, no harm is brought about to the subsequent internal chill method or coating with molten aluminum.

As the specific means for drying, mere exposure to the atmosphere is possible, but a relatively long time is required. Further, drying can be effected by blowing with warm air of from room temperature to 100° C. Alternatively, a hot air of 100°–200° C. may be blown. In particular, when a hot air is blown, the water content in the chemical conversion coating layer is lost and the chemical conversion coating layer is sintered onto the surface of the aluminum member, whereby the coating layer becomes even stronger. Furthermore, there is an advantage that in the subsequent step of contacting with molten aluminum, water vapor is not generated and thus the molten aluminum is not deteriorated unnecessarily, and harmful fluorine vapor is not generated.

The aluminum member having the chemical conversion coating layer obtained as above should preferably have the $K_2AlF_5$ adhering to the surface thereof in an amount of about 0.1–10 g/m$^2$ in order that the $K_2AlF_5$ may act as the flux in the subsequent step of contacting with molten aluminum.

Since the chemical conversion coating layer is firmly adhered to the surface of the aluminum member, the aluminum member may be formed into a desired shape after the step of the chemical conversion coating. Alternatively, it may be formed before the chemical conversion coating step. In particular, when the amount of the $K_2AlF_5$ deposited is 0.1–3 g/m$^2$, it does not break even if subjected to considerably severe processing. If the amount deposited exceeds 10 g/m$^2$, at the time of contacting with the molten aluminum, $K_2AlF_5$ will remain and the contact of the aluminum member with the molten aluminum may become insufficient.

When the chemical conversion coating is conducted on only part of the member, it is recommended to immerse it in the treating solution or to spray the treating solution onto the member after masking, for example by coating or covering the surface not to be treated with plastic film.

By bringing the aluminum member treated by the chemical conversion coating in contact with molten aluminum, a desired composite material is obtained. As the composite material, various kinds of shapes are considered. For instance when disposing a tubular or curved tubular aluminum member in a mold just as a conventional core and casting, an aluminum casting having a path inside thereof is obtained without using a core. Conventionally, it has been difficult to dispose cores properly in a mold and necessary to break the cores to pick up the casting after processing, however, according to this invention such processes as the above mentioned are unnecessary and various shaped castings are easily obtained.

According to this invention a composite aluminum plate having a corrosion resistant or abrasion resistant surface can also be obtained. Such a plate may be prepared by immersing continuously, for example, aluminum alloy strip in molten aluminum, in such manner as in processing aluminized steel.

The molten aluminum to be used in this invention may comprise aluminum or an aluminum alloy, which can be the same or different material as the aluminum member. In casting, it is preferable to use a molten aluminum having a little lower temperature than the melting point of the aluminum member. However, if the cavity is arranged in such a manner that it can be cooled, it is not necessary to consider the temperature of the molten aluminum.

With respect to the step of bringing the aluminum member during with the molten aluminum in the internal chill method, it is most preferable that it be conducted in a non-oxidative atmosphere. However, it may be conducted in an atmosphere containing a small amount of oxygen or, if circumstances require, it may be conducted in the air.

In this contacting step, $K_2AlF_5$ existing as the chemical conversion coating on the surface of the aluminum member may also act as a flux, so that the wettability of the aluminum member with molten aluminum is improved and excellent internal chill casting or aluminum coating can be obtained.

Although the details of the function of the chemical conversion according to this invention is unclear, it is presumed as follows:

The chemical conversion coating as a flux is heated in contact with the molten aluminum and melts, then the molten coating reacts with the oxide film of the surface of the aluminum member and removes it. The oxide film thus being removed, a clean surface of the aluminum member appears and the wettability of the member with the molten aluminum is improved. By this technique, even if the shape of the member is complex, the molten aluminum penetrates into all the corners thereof resulting in excellent bonding.

Furthermore, there will be no inconvenience associated with the residue of the chemical conversion coating, which remains on the part of the surface of the member which is not cast, since the coating, which is substantially insoluble in water, will not corrode the aluminum member.

A further understanding of the present invention can be obtained by reference to certain specific examples which are provided herein. These examples are provided for clarification only, and are not to be construed as limiting the scope of protection to be afforded by the appended claims.

EXAMPLE 1

Figure 2:
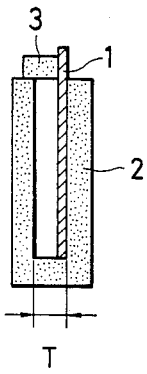
FIG. 2 is a sectional view showing a mold taken along the line B—B of FIG. 1.

As an aluminum member, a pure aluminum sheet 30 mm×130 mm in size with a thickness of 1 mm was prepared. This sheet 1 was disposed in a mold 2, as shown in FIGS. 1 and 2, in such a manner that one side thereof was in contact with an inner wall of the mold 2, and was cast. Thereafter, the bonding status between the member and the solidified aluminum casting was observed. In this example the mold was a shell mold or die having a width W of 70 mm, depth T of 15 mm and height H of 100 mm. For reference in FIGS. 1 and 2, the reference numeral 3 designates a sheet holder.

As a molten aluminum for the internal chill, AC2-B(Al-6.7%Si-3.2% Cu) and A 390(Al-17.5%Si-4.5%Cu-0.5% Mg) were used.

The chemical conversion coating was conducted by the immersing method in an aqueous solution of 8 g/l $KHF_2$.

In the casting process, pouring of the molten aluminum was conducted in such a manner that the flow of the molten aluminum did not directly dash against the aluminum sheet 1.

The results are shown in Table 1.

TABLE 1

| chemical conversion coating | mold | mold temp. | molten material | temp. of molten material (°C.) | result |
|---|---|---|---|---|---|
| not treated | shell mold | | AC2B | 670 | not bonded |
| | | | | 700 | " |
| treated (thin) | shell mold | | AC2B | 670 | completely bonded |
| treated (thin) | | | | 700 | completely bonded |
| treated (thick) | metal mold | 180° C. | AC2B | 670 | completely bonded |
| treated (thin) | (with mold wash) | 160° C. | | 700 | completely bonded |
| treated (thick) | metal mold | | AC2B | 640 | only top portion is not bonded |

TABLE 1-continued

| chemical conversion coating | mold | molten material | temp. of molten material (°C.) | result |
|---|---|---|---|---|
| treated (thick) | (without mold wash) | | 670 | only top portion is not bonded |
| treated (thick) | | | 680 | only top portion is not bonded |
| treated (thin) | shell mold | A390 | 670 | completely bonded |
| treated (thin) | | | 700 | completely bonded |

In this Table 1, "top portion" is designated in FIG. 1 as A. As seen from the results shown in Table 1, if the aluminum plate is not covered by the chemical conversion coating, the aluminum casting is not bonded to it. If the aluminum plate is covered, almost all results show good bonding. The term "thick" with respect to chemical conversion coating in Table 1 means that the amount of $K_2AlF_5$ is about 2 g/m$^2$ and "thin" means that the amount thereof is about 0.2 g/m$^2$.

Furthermore, the composite material obtained by Example 1 hardly peeled off during the peel test.

Figure 3:
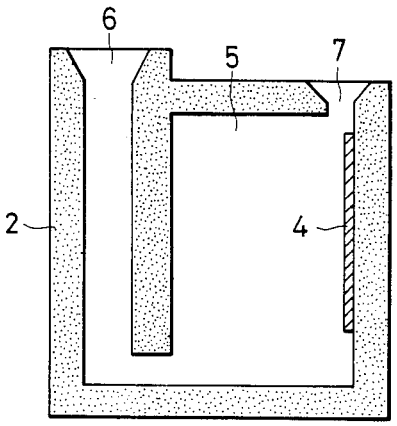
FIGS. 3 and 4 are sectional views showing other embodiments of the mold of the present invention.
Figure 4:
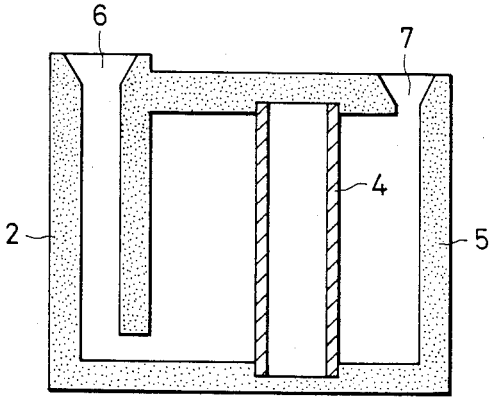
Figure 5:
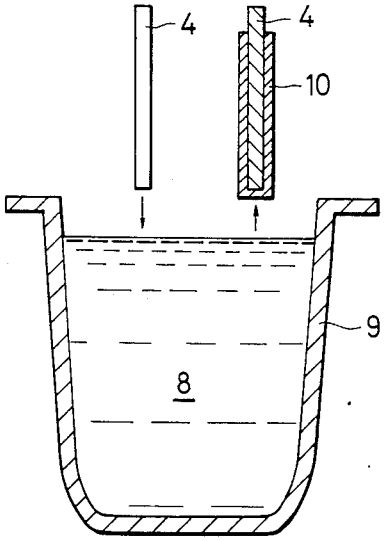
FIG. 5 is a sectional view of a crucible showing a step of aluminized method.

FIGS. 3 through 5 are drawings illustrating other embodiments of this invention. FIG. 3 shows one embodiment in which platelike members such as rolled aluminum plates are used as the aluminum member 4.

In FIG. 3 numeral 5 designates a casting part (cavity), numeral 6 designates a gate and numeral 7 designates a flow off (exhausting opening).

FIG. 4 shows a third embodiment in which a pipe is used as the aluminum member 4; such a pipe can, for instance, be a drawn aluminum pipe.

FIG. 5 shows, as a fourth embodiment, a method of obtaining an aluminized aluminum plate independent of the above three embodiments, in which an aluminum plate, as a member 4, such as rolled plate of aluminum alloys of JIS 3003, 1050 or 7072, etc. is used and it is immersed in molten aluminum 8 after conducting the chemical conversion coating according to Example 1 and is pulled up.

In FIG. 5, numeral 9 designates a crucible containing molten aluminum 8 and numeral 10 designates an aluminum film coating.

In this embodiment, the aluminum plate may be hard or soft, and as molten aluminum, pure aluminum for example can be used. A thus-obtained aluminum film bonded on the aluminum plate of 0.8 mm in thickness is 0.05 mm in thickness, and this film did not peel off under a bending test of 1 mm radium. Furthermore, under the Erichsen test, it also did not peel off.

According to this invention, by conducting the chemical conversion coating on an aluminum member, a complete bonding between an aluminum member and a casting, which has been considered impossible, can be easily obtained. As a result, a composite aluminum material having, for example, corrosion resistance and mechanical strength such as abrasion resistance can be obtained without losing the original advantageous lightweight properties thereof.

Furthermore, according to the method of this invention, since the aluminum member can be cast after it is formed and finished in a specified shape and the numbers of the members to be cast in a mold is not restricted, there is a possibility of forming a composite material having various and complicated shapes. Additionally, for a casting having shrinking problems at cooling due to the difference in thicknesses of its construction, by disposing appropriate members at the positions in a cavity such troubles can be effectively avoided.

Still further, according to this invention, there is such an advantage expected that, since the aluminum member can be surface coated in the molten aluminum, a composite aluminum material, having a desired aluminum coating layer on the surface thereof, can be obtained without being accompanied by drawbacks such as in the cladding method, in which the total thickness is changed or hardness is increased.

What is claimed is:

1. A method of preparing a composite aluminum material comprising the steps of:

contacting an aluminum member at least partially with a treating solution containing 0.5–40 g/1 of potassium ions and 1–10 moles of fluorine ions per mole of potassium ions, said treating solution used to form a chemical conversion coating layer of potassium pentafluoroaluminate on a specified surface of said member; and contacting said surface with a molten aluminum or aluminum alloy.

2. A method according to claim 1, wherein said treating solution is an aqueous solution containing 1–80 g/1 of $KHF_2$.

3. A method according to claim 1, wherein said treating solution is an aqueous solution of potassium fluoride (KF) and hydrogen fluoride (HF).

4. A method according to claim 1, wherein said aluminum member is contacted with said treating solution by a method selected from the group consisting of immersing, coating and spraying.

5. A method according to claim 1, wherein said potassium pentafluoroaluminate is formed in an amount of 0.1 to 10 g/m$^2$.

6. A method according to claim 1, wherein said surface is contacted with said molten aluminum or aluminum alloy by casting.

7. A method according to claim 1, wherein said surface is contacted with said molten aluminum or aluminum alloy by at least partially immersing the member in the molten aluminum or aluminum alloy.

8. A method according to claim 1, wherein said member is contacted with said molten aluminum or aluminum alloy in a non-oxidative atmosphere.

* * * * *